US005842728A

United States Patent [19]

Umino

[11] Patent Number: 5,842,728

[45] Date of Patent: Dec. 1, 1998

[54] IMPACT RESISTANT VEHICLE DOOR LATCH DEVICE

[75] Inventor: Masaaki Umino, Yamanashi-ken, Japan

[73] Assignee: Mitsui Kinzoku Kogyo Kabushiki Kaisha, Tokyo, Japan

[21] Appl. No.: 878,141

[22] Filed: Jun. 19, 1997

[30] Foreign Application Priority Data

Jun. 26, 1996 [JP] Japan ..... 8-185446

[51] Int. Cl.[6] ..... E05G 3/06

[52] U.S. Cl. ..... 292/216; 292/DIG. 41

[58] Field of Search ..... 292/DIG. 41, 216, 292/DIG. 73, DIG. 56, DIG. 57, DIG. 23, 336.3

[56] References Cited

U.S. PATENT DOCUMENTS

| | | | |
|---|---|---|---|
| 3,171,677 | 3/1965 | Klove | 292/216 |
| 3,572,792 | 3/1971 | Foley | 292/216 |
| 4,172,768 | 10/1979 | Cerdan | 292/216 |
| 5,000,495 | 3/1991 | Wolfgang | 292/216 |
| 5,427,421 | 6/1995 | Hamaguchi | 292/216 |
| 5,516,164 | 5/1996 | Kobayashi | 292/DIG. 23 |
| 5,582,444 | 12/1996 | Hayakawa | 292/216 |

FOREIGN PATENT DOCUMENTS 2302909 2/1997 United Kingdom .

*Primary Examiner*—Steven Meyers
*Assistant Examiner*—Gary Estremsky
*Attorney, Agent, or Firm*—Browdy and Neimark

[57] ABSTRACT

An impact resistant vehicle door latch device comprises a locking mechanism provided on a metal back plate fixed to a latch body. The locking mechanism has an inner locking lever which has a first base portion rotatably mounted to the back plate by a metal supporting shaft and a first tip portion extending toward an interior side of a door for being connected to an inside lock button, and an outer locking lever which has a second base portion rotatably mounted to the back plate by the supporting shaft and a second tip portion extending toward an exterior side of the door for being connected to a key cylinder. The supporting shaft has a large-diameter cylindrical part which supports the inner and outer locking levers, and a substantially annular flange which is integrally formed with the cylindrical part and has a plane surface perpendicular to an axis of the supporting shaft. The annular flange is located between the first base portion and second base portion.

12 Claims, 4 Drawing Sheets

IMPACT RESISTANT VEHICLE DOOR LATCH DEVICE

TECHNICAL FIELD OF THE INVENTION

The present invention relates to an improved impact resistant vehicle door latch device, and in particular, to a vehicle door latch device which can prevent a locking lever from being inoperative when a vehicle door is in particular deformed due to a traffic accident.

PRIOR ART OF THE INVENTION

It has been known that deformation of a vehicle door due to a traffic accident or the like, has frequently caused a locking lever in a door latch device to be mechanically locked so as to disable the latch device from being changed over from its locked condition to its unlocked condition.

FIG. 1 shows a conventional locking lever B of the door latch device A which has an outer arm E extending toward an outer panel C of a door for being connected to a key cylinder D of the door, and an inner arm H extending toward an inner panel F of the door for being connected to an inside locking button G of the door. Such a locking lever falls into an inoperative condition when the outer arm E is blocked or deformed by the outer panel C which has been deformed by an external force such as traffic accidents.

FIG. 2 shows another conventional latch device A' which comprises a locking lever divided into two components, that is, an outer locking lever B1 corresponding to the outer arm E and an inner locking lever B2 corresponding to the inner arm H. In this latch device A', the deformed outer panel C is substantially prevented from interfering with the inner locking lever B2 even though it interferes with the outer locking lever B1. Thus, the latch device A' would be displaced into the unlocked condition by turning the inner locking lever B2 with which the deformed outer panel C has not interfered. However, the inner locking lever B2 would be blocked by the outer locking lever B1 which has been deformed due to the external force, thereby the latch device A' cannot be displaced into the unlocked condition.

FIG. 3 shows an impact resistant vehicle door latch device A" which has been proposed in U.S. patent application Ser. No. 08/674,511, U.K. Patent Application No. 9613620.5 or German Patent Application No. 19626419.7 in the name of the present applicant. In this latch device A", a metal plate J which is located between the locking lever B1 and the locking lever B2 prevents the deformed locking lever B1 from blocking the inner locking lever B2.

The latch device A" shown in FIG. 3 has a problem such that the metal plate J is formed separately from a supporting shaft K which bears the two locking levers B1 and B2. As the metal plate J cannot support the outer locking lever B1 deformed by a larger external force in a direction of the arrow L, the metal plate J also becomes curved or deformed independently from the supporting shaft K, and a plane surface of the metal plate J becomes inclined relative to the center axis M of the supporting shaft K, thereby the inner locking lever B2 would be restricted from being turned.

SUMMARY OF THE INVENTION

It is, therefore, an object of the present invention to provide an impact resistant vehicle door latch device which improves the above mentioned prior art problems. To achieve the object, the supporting shaft is integrally incorporated with a flange which is located between the two locking levers.

BRIEF DESCRIPTION OF THE DRAWINGS

The above and other objects, features and advantages of the present invention will become apparent from the detailed description of the preferred embodiment found below with reference to the accompanying drawings in which.

PREFERRED EMBODIMENT OF THE INVENTION

Figure 1:
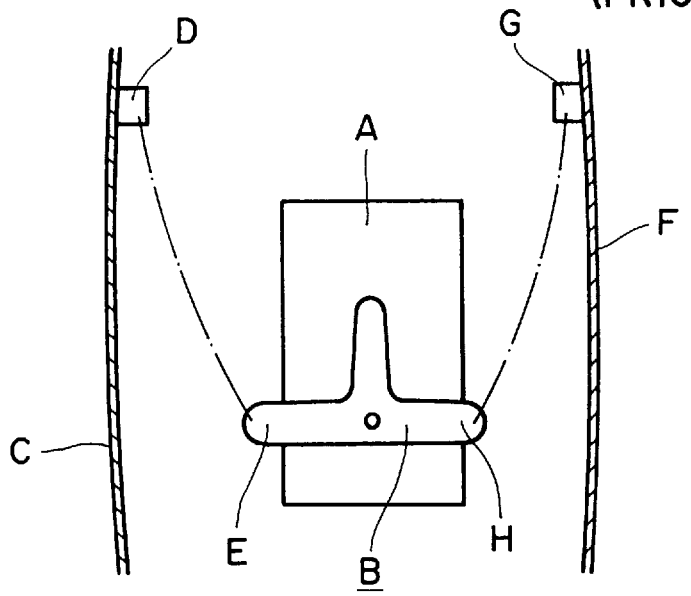
FIG. 1 (PRIOR ART)
FIG. 1 is a sectional view of a vehicle door which incorporate a prior art locking lever.
Figure 2:
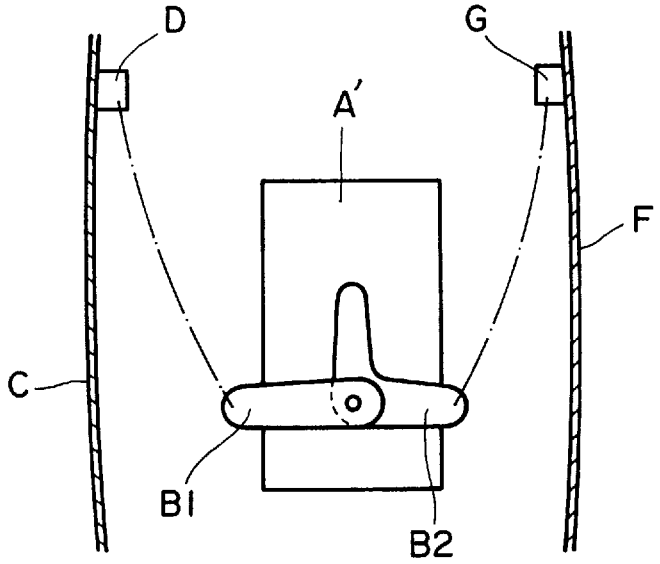
FIG. 2 (PRIOR ART)
FIG. 2 is a sectional view of a vehicle door which incorporate another prior art locking levers.
Figure 3:
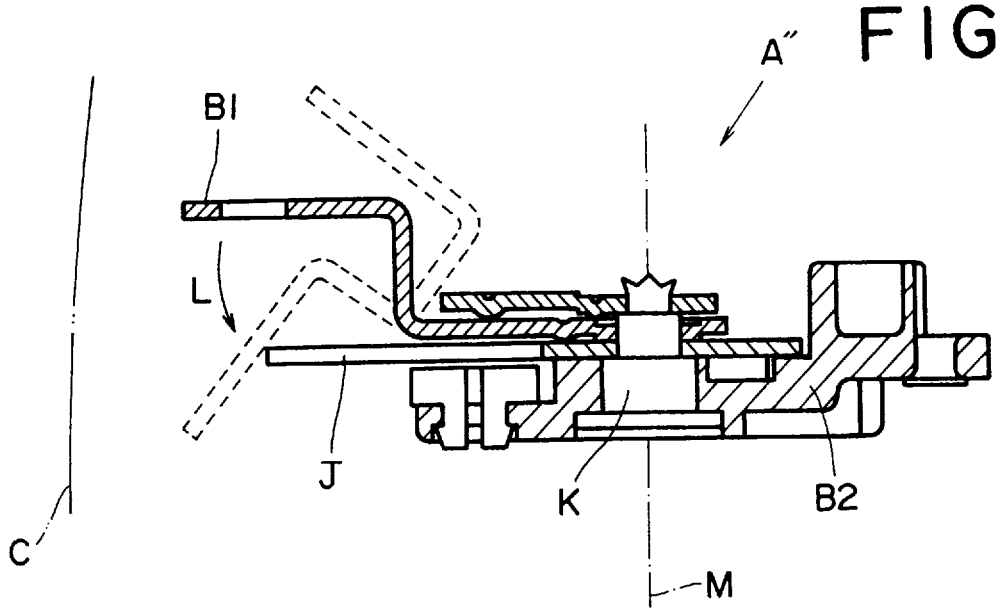
FIG. 3 is a sectional view of a vehicle door which has been proposed by the present applicant or assignee.
Figure 4:
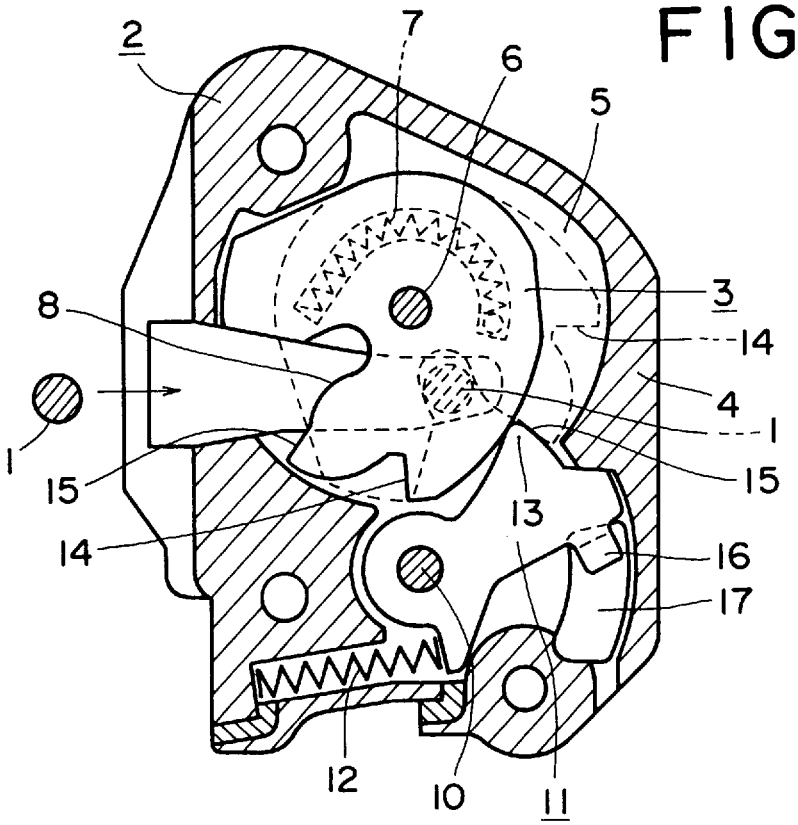
FIG. 4 is a longitudinal sectional view of a latch body of an improved impact resistant vehicle latch device according to the present invention.

Explanation will be hereinbelow made of an embodiment of the present invention with reference to the drawings. A latch device 2 according to the present invention comprises a latch 3 which is engageable with a striker 1 fixed to a vehicle body, and a ratchet 11 for holding the engagement between the latch 3 and the striker 1. The latch 3 and the ratchet 11 are rotatably received in a recess 5 formed in a synthetic latch body 4 by means of a latch shaft 6 and a ratchet shaft 10, respectively. The latch 3 is urged clockwise, as viewed in FIG. 4, by the resilient force of a spring 7, and the ratchet 11 is urged counterclockwise by the resilient force of a spring 12.

The latch 3 is turned counterclockwise against the resilient force of the spring 7 when the striker 1 is engaged with a fork part 8 of the latch 3, and the latch device 2 falls into a half-latched condition when a pawl part 13 of the ratchet 11 is engaged with a half-latched step part 14 of the latch 3 while it falls in a full-latched condition when the pawl part 13 is engaged with a full-latched step part 15 of the latch 3.

The ratchet 11 has a protrusion 16 which projects into the rear side of the latch body 4 through an opening 17 of the latch body 4. As the protrusion 16 is moved downward by an opening operation of a door opening mechanism described hereinbelow, the ratchet 11 is released from the latch 3 so as to open the door.

Figure 5:
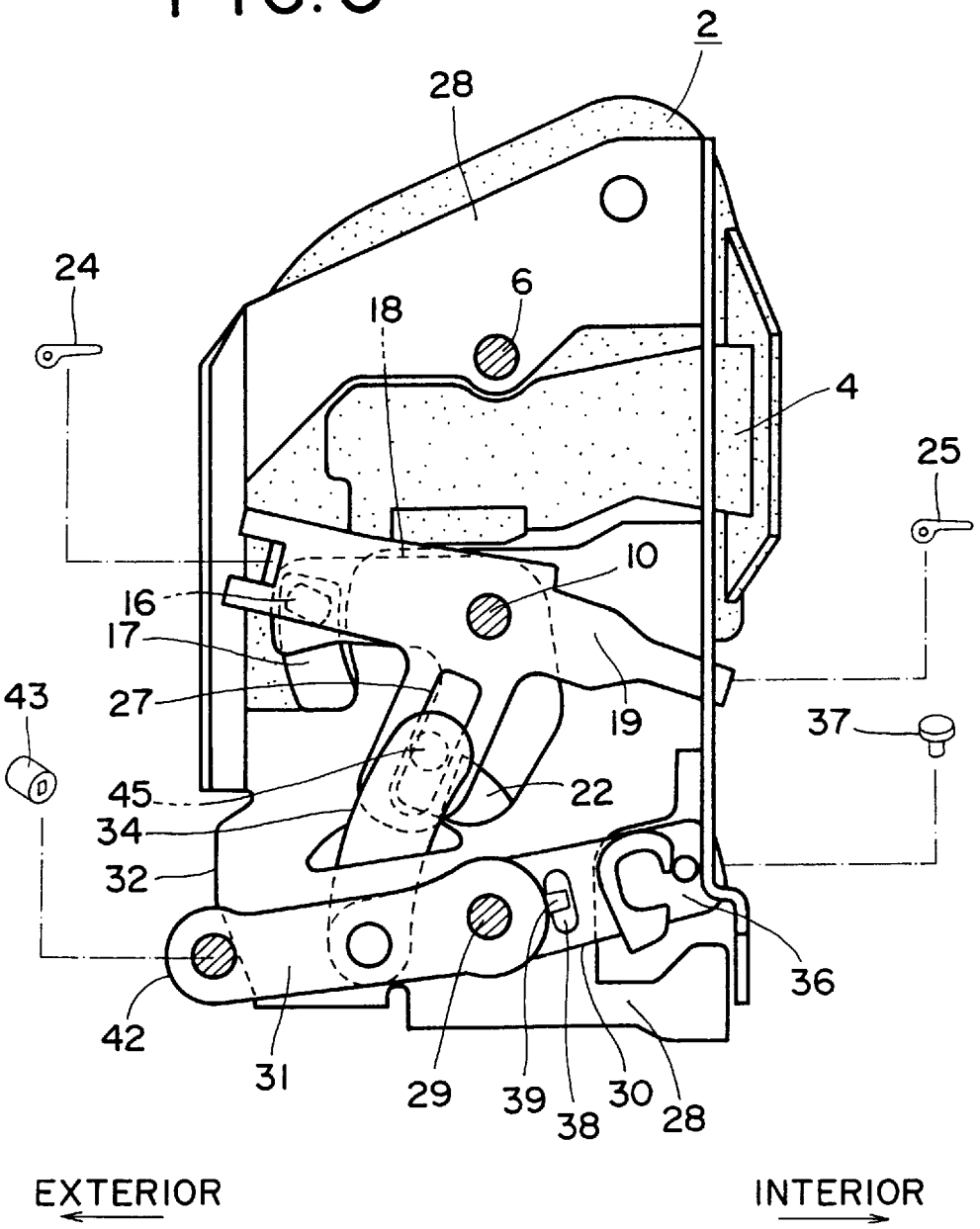
FIG. 5 is a rear view of the door latch device.

FIG. 5 shows the door opening mechanism and a locking mechanism of the latch device 2, both of which are provided on the rear side of the latch body 4. The opening mechanism has an L-shaped ratchet lever 18 which is connected to the protrusion 16, and a T-shaped opening lever 19 which is turned by an operation of an outer open handle 24 and/or an inner open handle 25. The levers 18 and 19 are rotatably supported to the ratchet shaft 10.

The opening lever 19 has an elongated hole 27 in which a pin 45 of the locking mechanism is slidably engaged. The pin 45 is opposed to a protrusion 22 of the ratchet lever 18 when the locking mechanism is in an unlocked condition. Therefore, under the unlocked condition, the opening operation of the open handle 24 or 25 causes the pin 24 to push the protrusion 22, to thereby rotate the ratchet lever 18 and the ratchet 11 so as to open the door. Oppositely, under a locked condition, the pin 45 is separated from the protrusion 22; therefore, the pin 45 cannot push the protrusion 22 even though the open handle 24 or 25 is manipulated for opening the door.

A metal back plate 28 is secured to the rear side of the latch body 4 by using fastener such as bolts, screws or rivets. The ratchet lever 18 and the opening lever 19 are located on the rear side of the back plate 28.

The locking mechanism has an inner locking lever 30 to be coupled to an inside lock button 37 of the vehicle door, and an outer locking lever 31 to be coupled to a key cylinder 43 of the door. A base portion 33 see (FIG. 6) of the inner locking lever 30 and a base portion 35 of the outer locking lever 31 are rotatably attached to the back plate 28 by means of a metal supporting shaft 29. A tip portion 36 of the inner locking lever 30 extends toward the interior side of the vehicle door so as to be coupled to the lock button 37, and a tip portion 42 of the outer locking lever 31 extends toward the exterior side of the door so as to be coupled to the door key cylinder 43.

A link 34 is connected at its one end to the inner locking lever 30, and is provided at the other end with the pin 45. The inner locking lever 30 has a slot or cut-out portion 38 in which a bent piece 39 of the outer locking lever 31 is engaged with a lost-motion.

Figure 6:
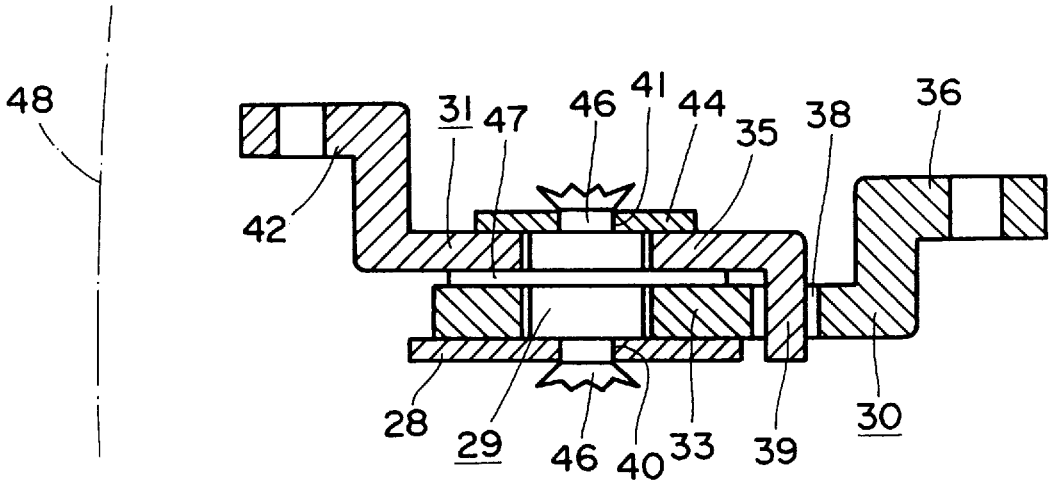
FIG. 6 is a sectional view of two locking levers attached to a back plate by a supporting shaft.
Figure 7:
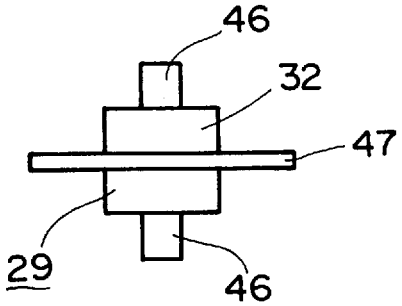
FIG. 7 is a plan view of the supporting shaft.

Referring to FIG. 7, the supporting shaft 29 according to the present invention is composed of a large-diameter cylindrical part 32 for supporting the inner and outer locking levers 30, 31, a pair of small-diameter pins 46 integrally formed with opposite sides of the cylindrical part 32, and an annular flange 47 integrally formed with the middle part of the cylindrical part 32 by a squeezing process. The annular flange 47 projects in a radial direction of the supporting shaft (cylindrical part) and is located between the inner locking lever 30 and the outer locking lever 31, as shown in FIGS. 5 and 6, so as to separate them from each other in order to prevent them from making contact with each other.

One of the pins 46 is inserted into a hole 40 formed in the back plate 28, and is then fixed to the back plate 28 by caulking, i.e. deforming the end of the pin to provide an enlarged portion. Meanwhile, the other of the pins 46 is inserted into a hole 41 formed in a metal sub plate 44 which is fixed to the back plate 28, and is then fixed to the sub plate 44 by caulking. The inner locking lever 30 is held between the back plate 28 and the flange 47 so as to be prevented from rattling, and the outer locking lever 31 is held between the sub plate 44 and the flange 47 so as to be prevented from rattling. The opposite sides of the supporting shaft 29 are supported by the two plates 28 and 44, respectively, so as to give a tough structure.

When the tip portion 42 of the outer locking lever 31 is pushed by an outer panel 48 of the door which is largely deformed due to an external force such as traffic accidents, the outer locking lever 31 would be bent toward the inner locking lever 30 in a direction of the arrow a. In such a case, the external force exerted to the outer locking lever 31, is received by the flange 47 so as to be prevented from being transmitted to the inner locking lever 30. Accordingly, even though the outer locking lever 31 cannot be turned, the inner locking lever 30 can be maintained in an operative condition.

Further, according to the present invention, since the flange 47 is integrally incorporated with the supporting shaft 29, the external force exerted to the flange 47 is directly transmitted to the supporting shaft 29 which is supported by the two metal plates 28 and 44. Therefore, the external force is well absorbed.

Further, since the flange 47 is integrally incorporated with the supporting shaft 29, even though a larger external force is exerted to the flange 47, the angle between the plane surface of the flange 47 and the axis of the supporting shaft 29 is held at right angle, thereby it is possible to maintain the inner locking lever 30 in the operative condition.

What is claimed is:

1. A vehicle door latch device adapted to be installed into a vehicle door, comprising:

a latch body for accommodating a latch to be engaged with a striker of a vehicle body and a ratchet to be engaged with the latch for holding the engagement between the latch and the striker;

a door opening mechanism provided on a rear side of the latch body for releasing the ratchet from the latch;

a locking mechanism provided on the rear side of the latch body and displaceable between a locked condition for disabling an opening operation of the door opening mechanism and an unlocked condition for enabling the opening operation of the door opening mechanism;

a metal back plate fixed to the rear side of the latch body;

said locking mechanism having an inner locking lever and an outer locking lever, said inner locking lever having a first base portion which is rotatably mounted to the back plate by a metal supporting shaft and a first tip portion which extends from the first base portion in a first direction which is toward an interior side of the vehicle door for connection to an inside lock button of the vehicle door when installed in the vehicle door;

said outer locking lever having a second base portion which is rotatably mounted to the back plate by the supporting shaft and a second tip portion which extends from the second base portion in a second direction opposite said first direction and toward an exterior side of the vehicle door for connection to a key cylinder of the vehicle door when said latch device is installed in the vehicle door;

wherein said supporting shaft has a large-diameter cylindrical part which supports the inner and outer locking levers, and a substantially annular flange which is integrally formed with the cylindrical part and has a plane surface perpendicular to an axis of the supporting shaft, said annular flange being located between the first base portion and second base portion.

2. A vehicle door latch device according to claim 1, wherein said supporting shaft has a first small-diameter portion which is fixed to the base plate.

3. A vehicle door latch device according to claim 1, wherein said supporting shaft has a small-diameter portion which is fixed to the base plate by caulking.

4. A vehicle door latch device according to claim 2, further comprising a metal sub plate to which a second small-diameter portion of the supporting shaft is fixed.

5. A vehicle door latch device according to claim 4, wherein said second small-diameter portion is fixed to the sub plate by caulking.

6. A vehicle door latch device according to claim 3, wherein said sub plate is fixed to the base plate.

7. In a vehicle door comprising a vehicle door body and a vehicle door latch device adapted to latch and lock said vehicle door body in a vehicle frame, said latch device being carried within said vehicle door body, the improvement wherein said latch device comprises:

a latch body for accommodating a latch adapted to be engaged with a striker of the vehicle frame and a ratchet to be engaged with the latch for holding the engagement between said latch and the striker;

a door opening mechanism provided on a rear side of the latch body for releasing the ratchet from the latch;

a locking mechanism provided on the rear side of the latch body and displaceable between a locked condition for disabling an opening operation of the door opening mechanism and an unlocked condition for enabling the opening operation of the door opening mechanism;

a metal back plate fixed to the rear side of the latch body;

said locking mechanism having an inner locking lever and an outer locking lever, said inner locking lever having a first base portion which is rotatably mounted to the back plate by a metal supporting shaft and a first tip portion which extends from the first base portion to an interior side of said vehicle door body and is connected to an inside lock button of said vehicle door body, said outer locking lever having a second base portion which is rotatably mounted to the back plate by the supporting shaft and a second tip portion which extends from the second base portion to an exterior side of the vehicle door body and is connected to a key cylinder of the vehicle door;

wherein said supporting shaft has a large-diameter cylindrical part which supports the inner and outer locking levers, and a substantially annular flange which is integrally formed with the cylindrical part and has a plane surface perpendicular to an axis of the supporting shaft, said annular flange being located between the first base portion and second base portion.

8. A vehicle door according to claim 7, wherein said supporting shaft has a first small-diameter portion which is fixed to the base plate.

9. A vehicle door according to claim 7, wherein said supporting shaft has a small-diameter portion which is fixed to the base plate by caulking.

10. A vehicle door according to claim 8, further comprising a metal sub plate to which a second small-diameter portion of the supporting shaft is fixed.

11. A vehicle door according to claim 10, wherein said second small-diameter portion is fixed to the sub plate by caulking.

12. A vehicle door according to claim 9, wherein said sub plate is fixed to the base plate.

* * * * *